United States Patent [19]

Kaczmarski et al.

[11] Patent Number: 4,676,028

[45] Date of Patent: Jun. 30, 1987

[54] HONING TOOL

[75] Inventors: Edward Z. Kaczmarski; Richard Grigsby, both of London, England

[73] Assignee: BICC Public Limited Company, London, England

[21] Appl. No.: 848,405

[22] Filed: Apr. 4, 1986

[30] Foreign Application Priority Data

Apr. 9, 1985 [GB] United Kingdom ..... 8509028

[51] Int. Cl.[4] ..... B24B 5/24

[52] U.S. Cl. ..... 51/105 R; 51/103 R; 51/170 PT; 51/237 R; 144/28.8; 279/1 Q; 76/DIG. 5

[58] Field of Search ..... 51/103 R, 103 C, 105 R, 51/161, 229, 237 R, 237 M, 289 R, 72 R, 170 PT, 208; 144/28.2, 28.3, 28.6, 28.7, 28.8, 28.9; 76/DIG. 5; 409/165, 166, 218, 226; 279/1 Q

[56] References Cited

U.S. PATENT DOCUMENTS

| | | | |
|---|---|---|---|
| 447,860 | 3/1891 | Armstrong | 144/28.7 X |
| 448,723 | 3/1891 | Mills | 144/28.8 |
| 818,433 | 4/1906 | Garst | 144/28.8 |
| 1,008,949 | 11/1911 | Canode | 144/28.8 |
| 1,131,529 | 3/1915 | Leicht | 51/105 R X |
| 2,455,019 | 11/1948 | McNeill | 279/1 Q |

FOREIGN PATENT DOCUMENTS

| | | | |
|---|---|---|---|
| 2252275 | 5/1974 | Fed. Rep. of Germany | 279/1 Q |
| 638563 | 6/1950 | United Kingdom | 51/105 R |
| 265664 | 6/1970 | U.S.S.R. | 51/105 R |

*Primary Examiner*—Robert P. Olszewski

*Attorney, Agent, or Firm*—Anthony C. Casella; Gerald E. Hespos

[57] ABSTRACT

A honing tool for sharpening an end of an electrode to be employed in the fusion splicing of optical fibres includes a rotatably mounted honing wheel of frustoconical shape and a rotatably mounted bush whose axis is parallel to that of the honing wheel and is so coupled to the honing wheel that, when the honing wheel is rotated with respect to the body of the tool, the bush will be rotatably driven in the same rotational direction. An electrode is so mounted coaxially within the bush that an end of the electrode will bear against the frustoconical surface of the honing wheel and that, when the honing wheel is rotated, rotation of the electrode with respect to the bush is prohibited and the abrasive frustoconical surface of the honing wheel will form a sharp point at the end of the electrode.

10 Claims, 3 Drawing Figures

HONING TOOL

FIELD OF THE INVENTION

This invention relates to a honing tool for use in forming a sharp point at an end of a substantially rigid elongate member of metal or metal alloy.

SUMMARY OF THE INVENTION

According to the invention, an improved honing tool comprises a support body a honing wheel which is rotatably mounted on the support body, which is of frusto-conical shape and, over substantially the whole of its frusto-conical surface, is of an abrasive material and which has an associated handle for rotating the honing wheel with respect to the support body; which support body has at least two throughbores parallel to the rotational axis of the honing wheel, the axis of each throughbore being spaced from the rotational axis of the honing wheel a distance different from that of the axis of the or each other throughbore; a bush which is rotatably mounted in a throughbores in the support body about an axis extending substantially parallel to the rotational axis of the honing wheel and which, when so rotatably mounted, is so directly or indirectly coupled to the honing wheel that, when the honing wheel is rotated with respect to the support body, the bush will be rotatably driven with respect to the support body; and means for so mounting a substantially rigid elongate member of metal or metal alloy coaxially within the bush that rotation of the elongate member with respect to the bush is substantially prohibited and an end of the elongate member will bear against a part of the frusto-conical surface of the honing wheel different from that when the elongate member is mounted in the bush and the bush is so rotatably mounted in the other throughbore or in one of the other throughbores, the arrangement being such that, when the honing wheel is rotated, said end of the elongate member will move relative to that part of the frusto-conical surface with which it is in contact and the abrasive frusto-conical surface will form a sharp point at said end of the elongate member.

Preferably, the bush, when rotatably mounted in any one of the throughbores, is so directly or indirectly coupled to the honing wheel that, when the honing wheel is rotated with respect to the support body, the bush will be rotatably driven in the same rotational direction and in this case the end of the elongate member at which a sharp point is to be formed and the part of the frusto-conical surface of the honing wheel with which it is in contact will be moving in opposite directions to one another. However, in some circumstances the bush, when rotatably mounted in any one of the throughbores, may be so directly or indirectly coupled to the honing wheel that, when the honing wheel is rotated with respect to the support body, the bush will be rotatably driven in the opposite rotational direction; in this latter case, said end of the elongate member in contact with the frusto-conical surface of the honing wheel will be moving in the same direction as, but at a speed different from that of, the part of the frusto-conical surface of the honing wheel with which it is in contact.

In its preferred form, the improved honing tool is in the form of a hand tool which can be readily slipped into a pocket or tool box of a user and which is especially, but not exclusively, suitable for use in sharpening or dressing the point of a substantially rigid elongate electrode of metal or metal alloy employed in the fusion splicing of optical fibres to remove from the point of the electrode silica and other undesirable materials that have accumulated thereon. The improved honing tool, when in the form of a hand tool, is also suitable for use in sharpening the point of a dart.

Preferably, one circumferentially continuous area of the frusto-conical surface of the honing wheel is of an abrasive material of a grade different, e.g. finer, from that of another circumferentially continuous area of the frusto-conical surface.

The means for mounting a metal elongate member in the bore of the bush preferably comprises a tubular cylinder which is a sliding fit in the bore of and is keyed to the bush and which has, in its bore, a shoulder against which a bushing of elastomeric material is urged by a tubular holder in the bore of which a metal elongate member can be a tight fit and which is adjustably engaged in the bore of the tubular cylinder, the elongate member in the tubular holder being restrained against rotational movement with respect to the bush by the bushing of elastomeric material.

Coupling of the honing wheel to the bush to ensure that the honing wheel and bush will both rotate in the same rotational direction preferably is effected by an endless belt or ring and, preferably also, a bush is rotatably mounted in each of at least two throughbores in the support body and the endless belt or ring is arranged to drive each of the bushes when the honing wheel is rotated. In this case, the tubular cylinder in which the tubular holder carrying an elongate member is mounted can itself be mounted in any one of said bushings as required without the necessity of disengaging and re-engaging the endless belt or ring.

Coupling of the honing wheel to the bush to ensure that the honing wheel and the bush will rotate in opposite rotational directions preferably is effected by providing on the bush a collar of elastomeric or other compressible material which is of such a diameter that it bears against the spindle of the honing wheel and through which the bush is frictionally driven.

The abrasive material at the frusto-conical surface of the honing wheel may be of any suitable composition but, preferably, the wheel is made of a diamond-impregnated material.

BRIEF DESCRIPTION OF THE DRAWINGS

The invention is further illustrated by a description, by way of example, of two forms of preferred hand tool for use in sharpening or dressing the point of a rigid elongate metal electrode employed in fusion splicing of optical fibres with reference to the accompanying drawings, in which.

DETAILED DESCRIPTION OF THE PREFERRED EMBODIMENTS

Figure 1:
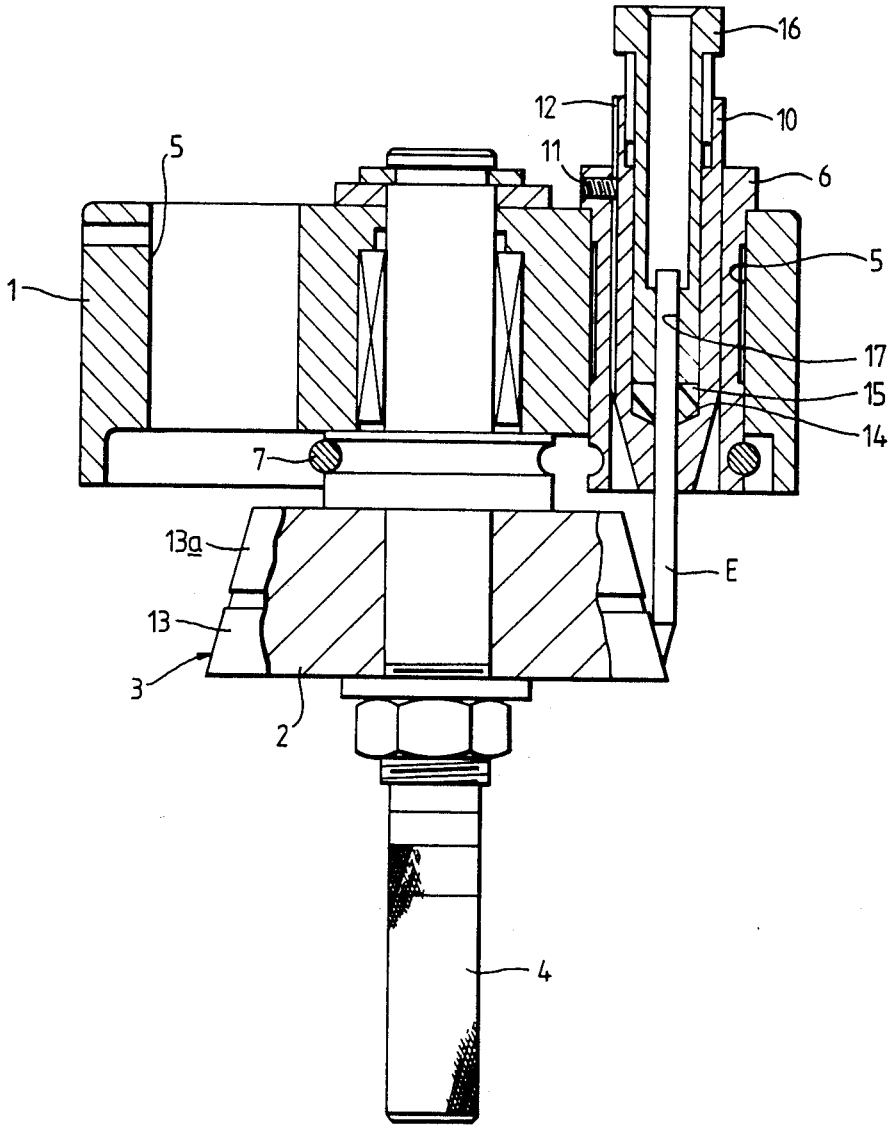
FIG. 1 is a sectional side view of the hand tool.

Referring to the drawings, the first form of preferred hand tool comprises a honing wheel 2 which is rotatably mounted on a support body 1, which is of frusto-conical shape and, over substantially the whole of its frusto-conical surface 3, is of an abrasive material and which has an associated handle 4 for rotating the honing wheel with respect to the support body. The support body has four circumferentially spaced throughbores 5, the axis of each of which is spaced from the axis of the honing wheel 2 a distance different from that of the axis of each other throughbore. Rotatably mounted in each of the throughbores 5 is a bush 6 (of which in FIG. 1 one only is shown) which is coupled to the honing wheel 2 by an endless drive ring 7 so that, when the honing wheel is rotated with respect to the support body 1, the bush will be rotatably driven in the same rotational direction.

A tubular cylinder 10 of metal is a sliding fit in the bore of and is keyed to one of the bushes 6 by a grub screw 11 engaging in a groove 12 in the tubular cylinder and has, in its bore, a shoulder 14 against wich a bushing 15 of elastomeric material is urged by a tubular holder 16 of metal which is in screw threaded engagement in the bore of the tubular cylinder and which has, over part of its length, a bore 17 which an elongate metal electrode E can be a tight fit. The electrode E is restrained against rotational movement with respect to the bush 6 by the bushing 15 of elastomeric material which is compressed when the tubular holder 16 is screwed into the tubular cylinder 10.

The frusto-conical surface 3 of the honing wheel 2 comprises two axially spaced circumferentially continuous areas 13 and 13*a*, the area 13*a* being of an abrasive material of a finer grade than that of the area 13.

When the hand tool is to be used to form a sharp point at an end of an elongate metal electrode E, the cylinder 10 with the electrode tightly fitted in the associated tubular holder 16 is fitted into the bush 6 so located that the protruding end of the electrode will bear against the circumferentially continuous area 13 of the frusto-conical surface 3. The honing wheel 2 is then rotated by means of the handle 4 to form a point at the protruding end of the electrode E which, when the honing wheel is rotated, rotates in the same rotational direction. The tubular cylinder 10 is then removed from the bush 6 and is introduced into another of the two bushes so that the protruding end of the electrode bears against the circumferentially continuous area 13*a* of the frusto-conical surface 3. By rotating the honing wheel 2, a fine sharp point is formed at the protruding end of the electrode E.

Figure 2:
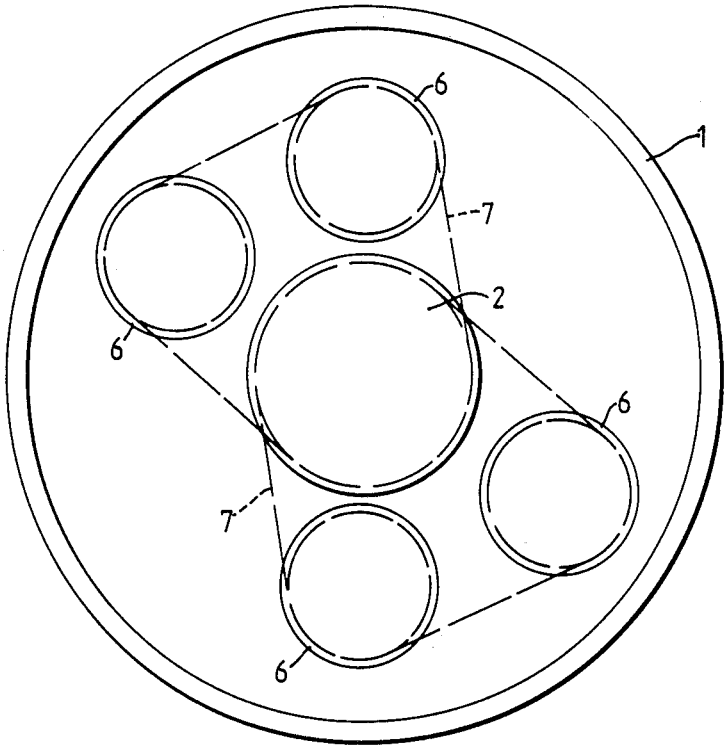
FIG. 2 is an end view of the support body of the hand tool shown in FIG. 1.
Figure 3:
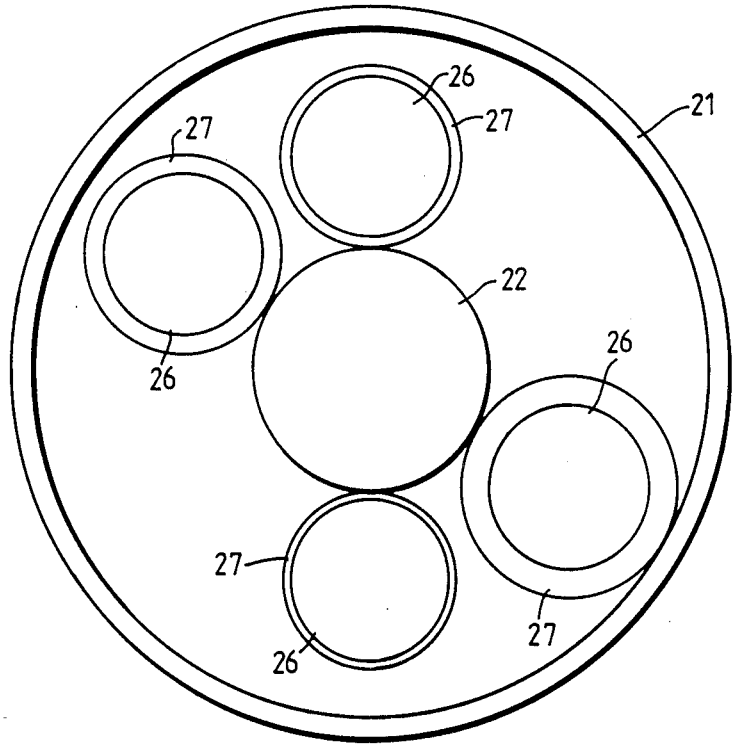
FIG. 3 is an end view of the support body of the second form of hand tool.

The second form of tool is of substantially identical construction to the hand tool shown in FIGS. 1 and 2 except for the means by which the four bushes are rotatably driven by the honing wheel. As will be seen on referring to FIG. 3, each of the bushes 26 has a collar 27 of elastomeric material which bears against the spindle of the honing wheel 22 so that, when the honing wheel is rotated with respect to the support body 1, each bush is frictionally driven through its collar in a rotational direction opposite to that of the honing wheel so that the end of the electrode supported in the bush will move in the same direction as, but at a speed different from that of, the part of the frusto-conical surface of the honing wheel with which it is in contact.

What we claim as our invention is:

1. A honing tool for use in forming a sharp point at the end of a substantially rigid elongate member of metal or metal alloy, which honing tool comprises: a support body; a honing wheel which is rotatably mounted on the support body, which is of frusto-conical shape and, over substantially the whole of its frusto-conical surface, is of an abrasive material and which has an associated handle for rotating the honing wheel with respect to the support body; which support body has at least two throughbores whose axes extend substantially parallel to the rotational axis of the honing wheel, the axis of each throughbore being spaced from the rotational axis of the honing wheel a distance different from that of the axis of each other throughbore; a bush which is rotatably mounted in any one of said throughbores in the support body about an axis extending substantially parallel to the rotational axis of the honing wheel and which, when so rotatably mounted, is so coupled to the honing wheel that, when the honing wheel is rotated with respect to the support body, the bush will be rotatably driven with respect to the support body; and means for so mounting a substantially rigid elongate member of metal or metal alloy coaxially within the bush that rotation of the elongate member with respect to the bush is substantially prohibited and an end of the elongate member will bear against a part of the frusto-conical surface of the honing wheel different from that when the elongate member is mounted in the bush and the bush is rotatably mounted in a different one of said throughbores, the arrangement being such that, when the honing wheel is rotated, said end of the elongate member will move relative to that part of the frusto-conical surface with which it is in contact and the abrasive frusto-conical surface will form a sharp point at said end of the elongate member.

2. A honing wheel as claimed in claim 1, wherein the means for mounting the metal elongate member in the bore of the bush comprises a tubular cylinder which is a sliding fit in the bore of and is keyed to the bush and which has, in its bore, a shoulder against which a bushing of elastomeric material is urged by a tubular holder in the bore of which the metal elongate member can be a tight fit and which is adjustably engaged in the bore of the tubular cylinder, the elongate member in the tubular holder being restrained against rotational movement with respect to the bush by the bushing of elastomeric material.

3. A honing wheel as claimed in claim 1, wherein the bush, when rotatably mounted in any one of the throughbores, is so coupled to the honing wheel that, when the honing wheel is rotated with respect to the support body, the bush will be rotatably driven in the same rotational direction.

4. A honing tool as claimed in claim 3, wherein the honing wheel is coupled to the bush by an endless ring.

5. A honing tool as claimed in claim 1, wherein a bush is rotatably mounted in each of at least two of said throughbores in the support body and the honing wheel is coupled to each of the bushes by a separate endless ring.

6. A honing wheel as claimed in claim 1, wherein the bush, when rotatably mounted in any one of the throughbores, is so coupled to the honing wheel that, when the honing wheel is rotated with respect to the support body, the bush will be rotatably driven in the opposite rotational direction and the end of the elongate member in contact with the frusto-conical surface of the honing wheel will move in the same direction as, but at a speed different from that of, the part of the frusto-conical surface of the honing wheel with which it is in contact.

7. A honing wheel as claimed in claim 6, wherein the bush has a collar of compressible material which is of such a diameter that it bears against the spindle of the honing wheel and through which the bush can be rotatably driven.

8. A honing tool as claimed in claim 1, wherein one circumferentially continuous area of the frusto-conical surface of the honing wheel is of an abrasive material of a grade different from that of another circumferentially continuous area of the frusto-conical surface.

9. A honing tool as claimed in claim 1, wherein the abrasive material at the frusto-conical surface of the honing wheel is made of a diamond-impregnated material.

10. A honing tool as claimed in claim 1, wherein the tool is in the form of a hand tool.

* * * * *